US010900251B2

(12) United States Patent
Ferrari et al.

(10) Patent No.: US 10,900,251 B2
(45) Date of Patent: Jan. 26, 2021

(54) COLLAPSIBLE, ERECTABLE CANOPY SHELTER WITH A CRANK SYSTEM

(71) Applicant: Dick's Sporting Goods, Inc., Coraopolis, PA (US)

(72) Inventors: Lucas Ferrari, Clinton, PA (US); Chinawut Paesang, Sewickley, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 0 days.

(21) Appl. No.: 16/564,359

(22) Filed: Sep. 9, 2019

(65) Prior Publication Data

US 2020/0002968 A1 Jan. 2, 2020

Related U.S. Application Data

(63) Continuation of application No. 15/655,519, filed on Jul. 20, 2017, now Pat. No. 10,407,940.

(60) Provisional application No. 62/364,669, filed on Jul. 20, 2016.

(51) Int. Cl.
*E04H 15/50* (2006.01)
*E04H 15/32* (2006.01)

(52) U.S. Cl.
CPC ..... *E04H 15/50* (2013.01); *E04H 15/32* (2013.01)

(58) Field of Classification Search
CPC ..... E04H 15/50
See application file for complete search history.

(56) References Cited

U.S. PATENT DOCUMENTS

| | | | |
|---|---|---|---|
| 4,844,109 | A | 7/1989 | Navarro |
| 4,880,024 | A | 11/1989 | Brell |
| 5,797,411 | A | 8/1998 | Parker |
| 6,470,902 | B1 | 10/2002 | Carter |
| 6,508,262 | B1 | 1/2003 | Takayama |
| 2002/0074032 | A1 | 6/2002 | Park et al. |
| 2005/0205124 | A1 | 9/2005 | Goldwitz |
| 2006/0185704 | A1 | 8/2006 | Guo et al. |
| 2007/0144572 | A1 | 6/2007 | Patel et al. |
| 2008/0190474 | A1 | 8/2008 | Seo |
| 2009/0217959 | A1 | 9/2009 | Carter |

(Continued)

FOREIGN PATENT DOCUMENTS

| | | | |
|---|---|---|---|
| CN | 1154154 | A | 7/1997 |
| CN | 2262590 | Y | 9/1997 |

(Continued)

*Primary Examiner* — David R Dunn
*Assistant Examiner* — Danielle Jackson
(74) *Attorney, Agent, or Firm* — Fox Rothschild LLP

(57) ABSTRACT

A canopy erectable by a single user by use of a crank assembly. The canopy is constructed of an expandable frame including legs, vertical rotating members, and horizontal rotating members. Each leg has a foot on one end. One foot has a stepping portion and each of the remaining feet have a sliding portion. The vertical rotating members are each connected to one leg and are movably connected to each other vertical rotating member at a centerpoint. The horizontal rotating members are each rotatably connected between two different legs at a fixed point on each leg. Each leg also has a movable bracket slidably connected to it and the bracket is rotably connected to each adjacent horizontal rotating member. A crank is affixed to the leg with the first foot; wherein the crank is operably connected to control the position of the movable bracket.

15 Claims, 9 Drawing Sheets

(56) References Cited

U.S. PATENT DOCUMENTS

| | | | |
|---|---|---|---|
| 2010/0006131 | A1 | 1/2010 | Liu |
| 2011/0108079 | A1 | 5/2011 | Mallookis et al. |
| 2016/0348392 | A1 | 12/2016 | Jin |

FOREIGN PATENT DOCUMENTS

| | | | |
|---|---|---|---|
| CN | 2663594 | Y | 12/2004 |
| CN | 201512985 | U | 6/2010 |
| CN | 203716614 | U | 7/2014 |
| CN | 104863415 | A | 8/2015 |
| DE | 20313518 | U1 | 12/2003 |
| WO | 2018017857 | A2 | 1/2018 |

COLLAPSIBLE, ERECTABLE CANOPY SHELTER WITH A CRANK SYSTEM

CROSS REFERENCE TO RELATED APPLICATIONS

This application claims priority to, and is a continuation application of U.S. patent application Ser. No. 15/655,519, entitled "Collapsible, Erectable Canopy Shelter With a Crank System", filed Jul. 20, 2017, which claims priority to provisional application No. 62/364,669, also entitled "Collapsible, Erectable Canopy Shelter With a Crank System" that was filed on Jul. 20, 2016, the disclosures of which are herein incorporated by reference in their entireties.

FIELD OF THE DISCLOSURE

The present disclosure relates generally to folding, collapsible canopy structures, and more particularly relates to a collapsible, erectable canopy shelter with a crank system.

BACKGROUND OF RELATED ART

Temporary canopy shelters that can be easily transported and rapidly set up and collapsed have proven to be useful in providing temporary shelter. For instance, erectable canopies may be utilized for a variety of purposes, including, for instance, camping, tailgating, sales, beach shelter, or any other suitable use.

As described in U.S. Pat. No. 6,470,902, one known erectable, collapsible shelter includes a framework of X-shaped linkages, telescoping legs, and a canopy covering the framework. The legs of that shelter are capable of telescoping to about twice their stowed length, and the framework of X-shaped truss pairs is capable of horizontal extension between the legs to support a canopy. The framework can be constructed of lightweight material, and the telescoping legs can be extended to raise the framework of the shelter. Erecting and/or collapsing the canopy can be an exercise in frustration as the canopy typically requires at least two people to pull, push, erect, and/or take down each of the frame pieces.

Thus, there remains a need for an improved, erection and/or collapsing mechanism that will assist a user in erecting and/or collapsing the canopy in an expedited manner.

DETAILED DESCRIPTION

The following description of example methods and apparatus is not intended to limit the scope of the description to the precise form or forms detailed herein. Instead the following description is intended to be illustrative so that others may follow its teachings.

An example of a new crank system assembly is illustrated. The example crank system is shown along with a current "instant up" canopy, such as for instance a Quest Q64 10 ft×10 ft canopy system. It will be understood that the described crank system may be adapted and configured for any expandable canopy system as desired.

In use, the canopy shelter would be deployed by a single user. The tent is secured in place by first stepping on one foot. The user engages a crank on that same leg extending the extensible members in every direction. The remaining feet slide across the ground as a extensible frame powered by the crank, deploys the legs of the canopy. A cover is placed over the frame.

Figure 1:
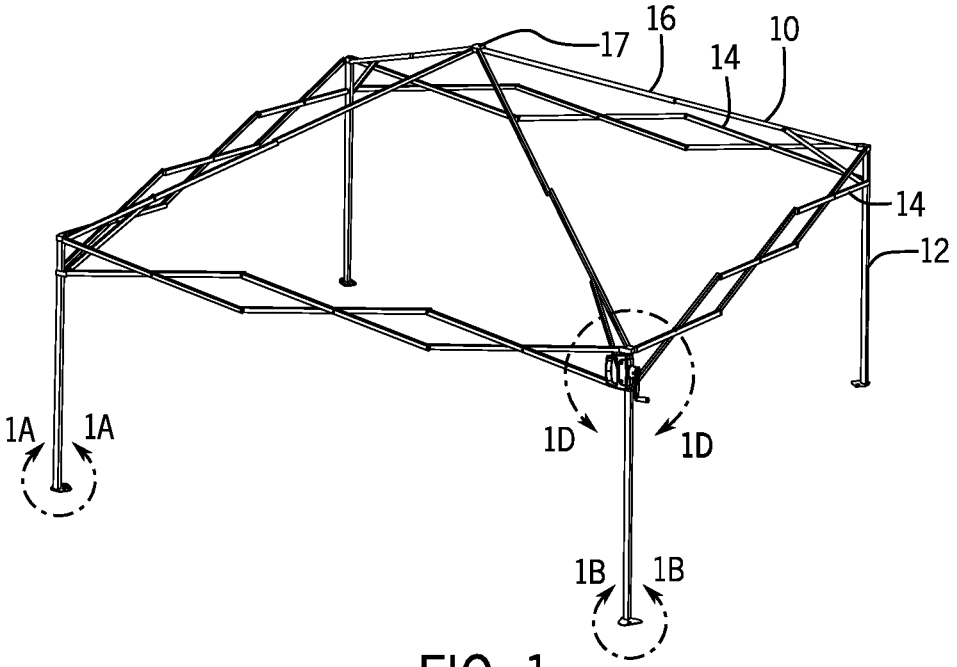
FIG. 1 is a top, perspective view of the collapsible canopy shelter of the present disclosure.
Figure 1A:
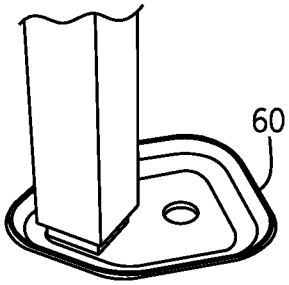
FIG. 1A is an enlarged view of an example sliding foot for use with the canopy shelter of FIG. 1.
Figure 1B:
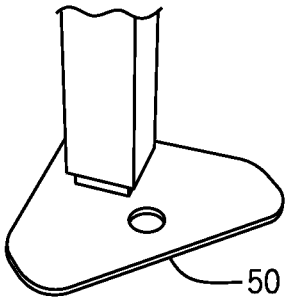
FIG. 1B is an enlarged view of an example of a foot step for use with the canopy shelter of FIG. 1.
Figure 1C:
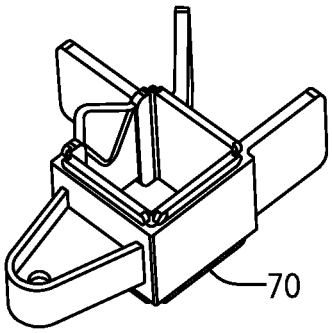
FIG. 1C is an enlarged view of an example movable bracket for use with the canopy shelter of FIG. 1.
Figure 1D:
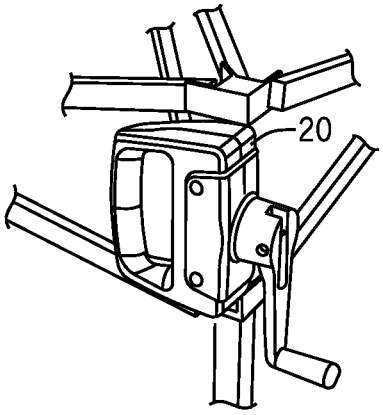
FIG. 1D is an enlarged view of an example crank assembly for use with the canopy shelter of FIG. 1.
Figure 2A:
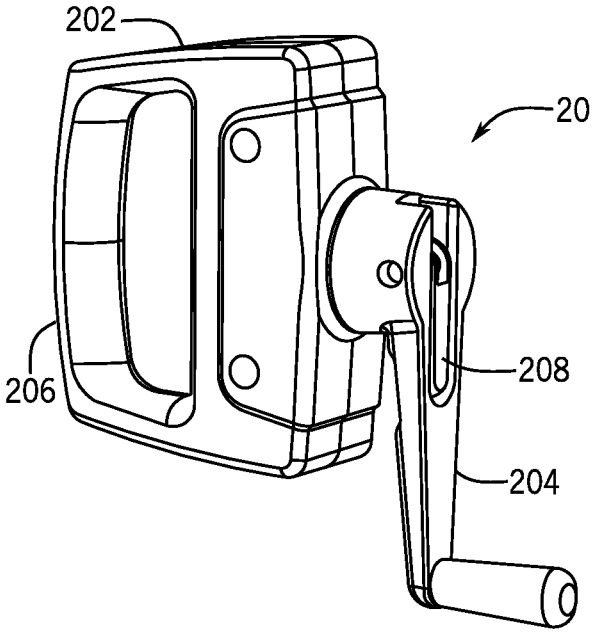
FIG. 2A is a perspective view of example crank assembly.
Figure 2B:
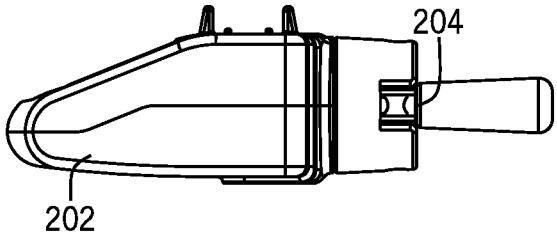
FIG. 2B is a top plan view of example crank assembly of FIG. 2A.
Figure 2C:
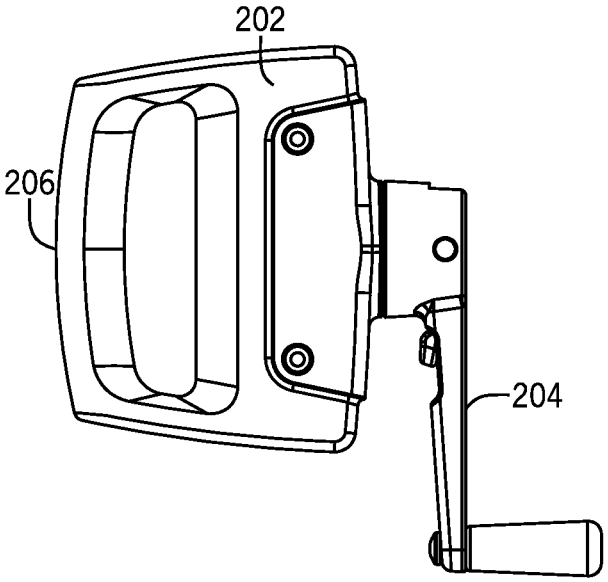
FIG. 2C is a side view of example crank assembly of FIG. 2A.
Figure 2D:
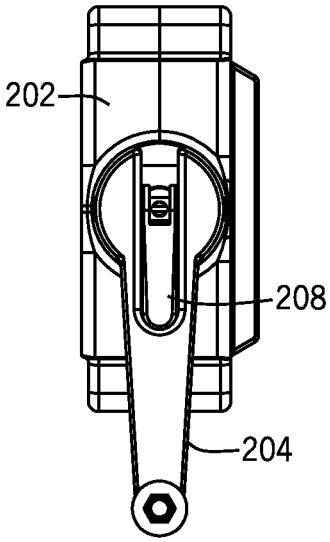
FIG. 2D is a front view of example crank assembly of FIG. 2A.

Referring now to the figures, FIG. 1 is a top, perspective view of the collapsible canopy shelter of the present disclosure. The canopy is shown in FIG. 1 in a deployed configuration where it could be covered with a rain fly (not shown) or other material to provide shade and/or protection from the elements. The detailed views of FIGS. 1A-1D show the components described further below, namely an example sliding foot in FIG. 1A, an example of a foot step in FIG. 1B, an example movable bracket in FIG. 1C, and an example crank assembly in FIG. 1D.

The canopy shelter 10 includes four legs 12, sometimes known as poles, are connected by a series of extensible members. In the example shown, these form a square tent with a squat, square based pyramidal roof, but one of ordinary skill in the art will appreciate that a number of forms will be operable examples of the present disclosure, such as a triangular or octagonal based tent.

Horizontal extensible members 14 are connected between adjacent legs. Each horizontal member 14 is fixedly coupled to one leg and movably coupled to another leg with a sliding bracket 70. In the example shown, the horizontal extensible members 14 are arranged in a scissor-like configuration, but other extensible configurations, such as, for example, simple rotatable members or telescoping members are also appreciated in the teachings of this disclosure. The vertical extensible members 16 are rotatably connected to each other at a center point 17 forming the primary shape of the canopy. The vertical extensible members 16 each have a single elbow joint as in the example shown and are rotatably attached to their respective leg 12. The motion of the extensible members 14, 16 are driven by crank 20.

Referring to FIGS. 2A-D, the example crank assembly 20 is shown in further detail. The example crank 20 includes a housing 202, handle 204, grip 206, and release lever 208. The crank 20 is used to push the extensible members 14 apart by pulling on the sliding bracket 70 affixed to the same leg. In order to do so, the crank 20 is operably coupled to the sliding bracket 70 with a tether such as a rope. When the crank handle 204 is turned, this drives the extension of the extensible members by shortening the tether. By the movement of adjacent horizontal extensible members 14, the rest of the extensible frame is expanded until the canopy 10 is fully deployed.

Figure 3:
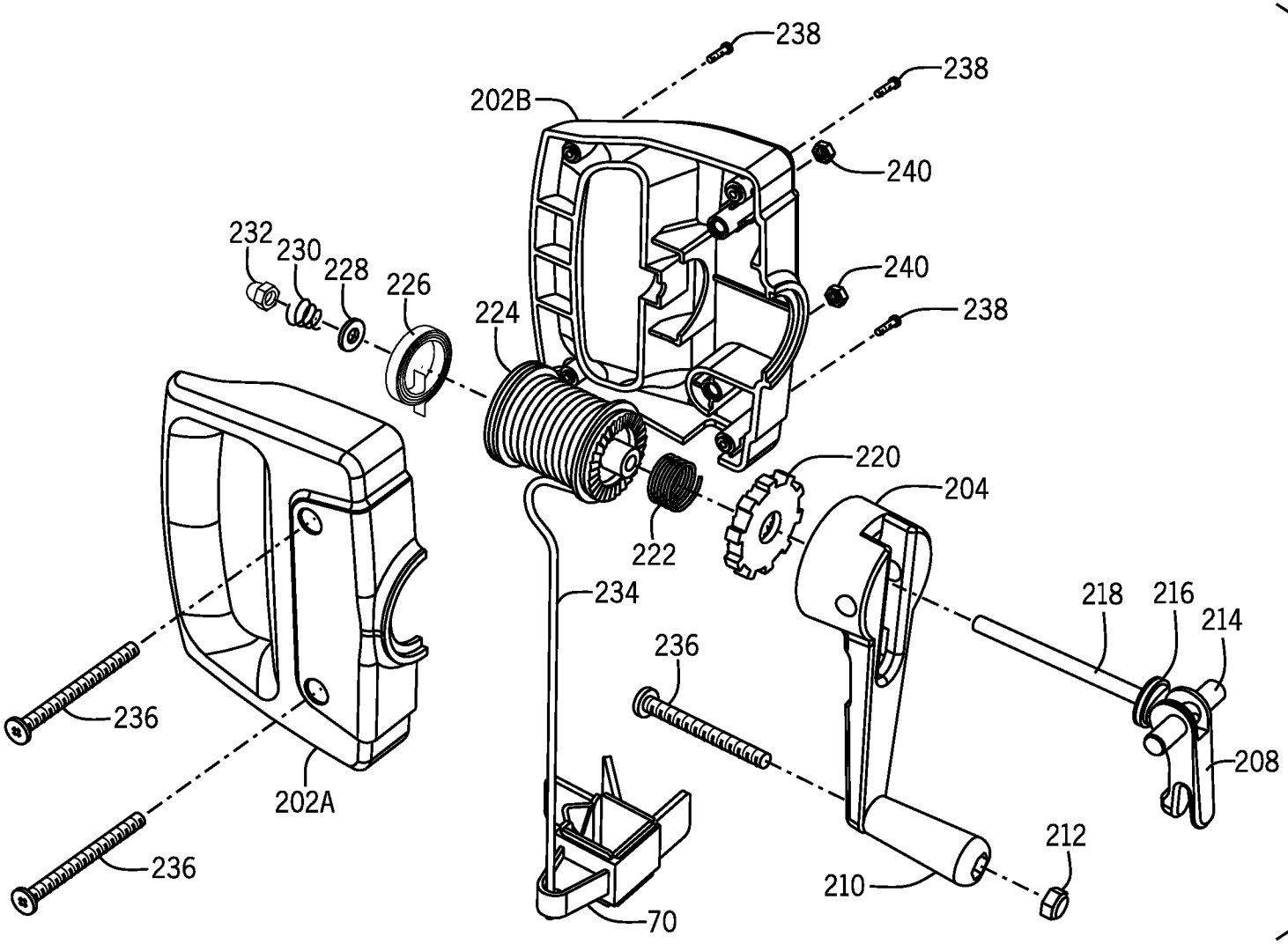
FIG. 3 is an exploded view of the example crank assembly.

The operation of crank 20 may be better understood as shown in FIG. 3 showing an exploded view of the example crank assembly. The housing 202 is shown in this example in two halves 202A, 202B. The crank handle 204 and knob 210 can be locked in place by use of the release lever 208. The release lever 208 rotates along release thread pin 214 and can lock the system by engaging a release axle 218 bearing a drive face gear 220 that releasably engages the spooling mechanism. The various components of the crank 20 in the example shown are affixed by any suitable fasteners such as machine screws 236, and thread forming screws 238 and their associated nuts and washers such as release lock nuts 212 and 240, push washer 216, and cap nuts 232.

The rope and spooling system of the crank 20 is spooled around the drive drum 224. Slack is controlled by a torsion spring 226 and a thrust bearing 228. The release axel 218 is biased by compression springs 222, 230. The rope 234 extends from the drum 224 to the sliding bracket 70 on the leg below. Turning the handle 204 spins the drum 224 applying tension to the rope 234 pulling on the sliding bracket 70. As described in further detail below, the upward motion of the sliding bracket 70 deploys the extensible frame. Sliding bracket 70 is discussed in more detail with respect to FIGS. 7A-D below.

Figure 4:
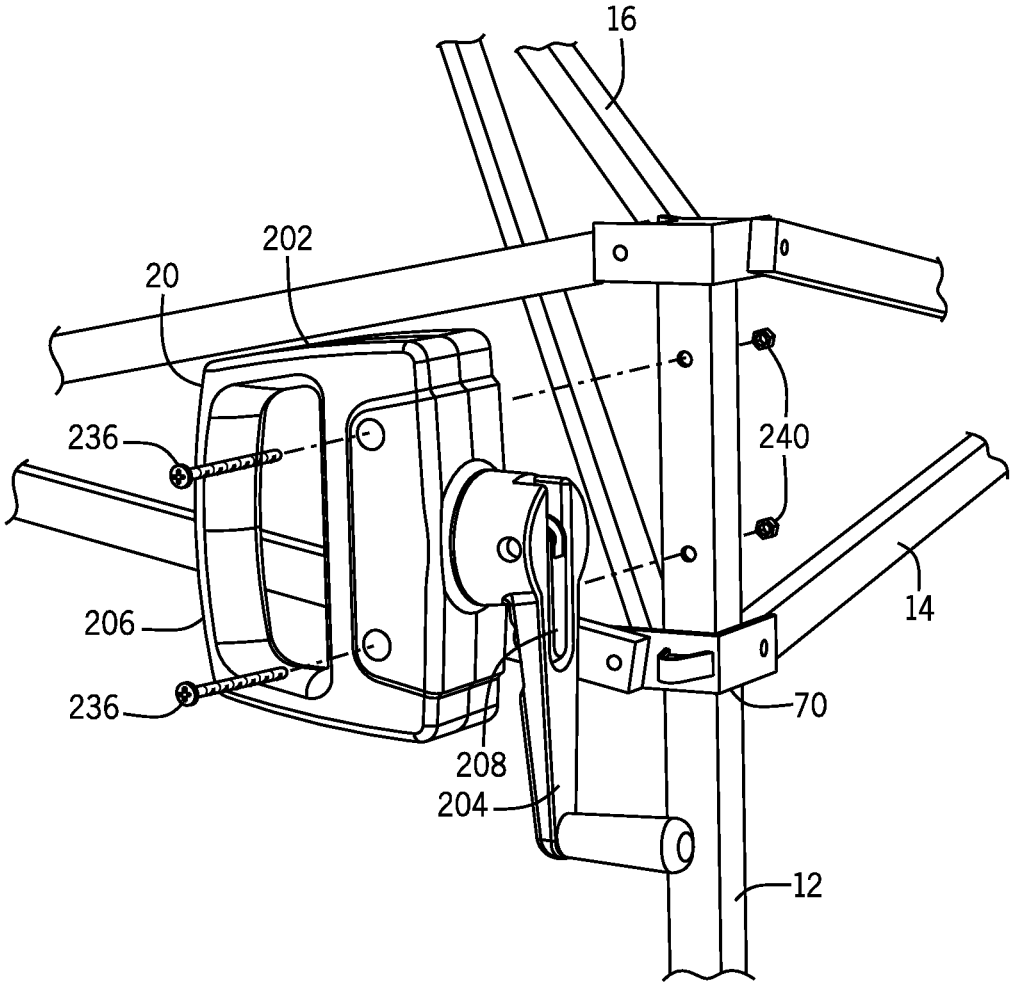
FIG. 4 is a partial assembly detail depiction of the example crank assembly for use with the example canopy shelter of FIG. 1.

FIG. 4 shows a partial assembly detail depiction of the example crank assembly 20 for use with the example canopy shelter. As shown, the crank 20 is mounted near the top of a leg 12 near the point that the leg 12 is attached to the vertical extensible member 16 and above the maximum vertical position of the sliding bracket 70.

Figure 5A:
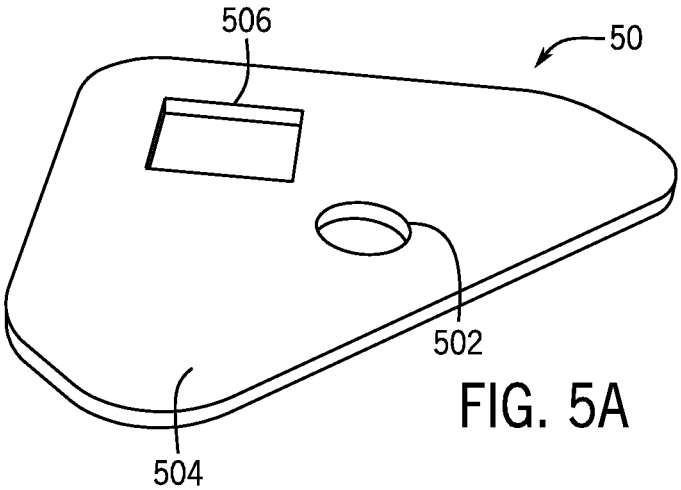
FIG. 5A illustrates a perspective view of an example anchoring foot for supporting the example canopy shelter of FIG. 1.
Figure 5B:
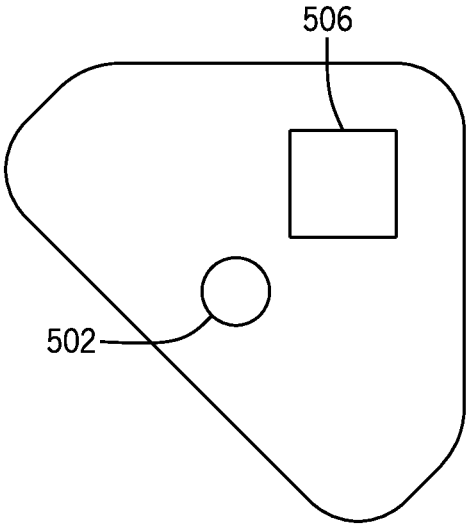
FIG. 5B is a top plan view of example anchoring foot of FIG. 5A.
Figure 5C:
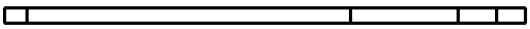
FIG. 5C is a side plan view of example anchoring foot of FIG. 5A.

FIGS. 5A-5C show an example anchoring foot 50 for supporting the example canopy shelter. Anchoring foot 50 has a staking opening 502, flat portion 504, and leg mounting point 506. Unlike the other feet, the anchoring foot 50 is adapted to be stepped on by the user when deploying the canopy. The flat portion 504 allows the user to securely plant the corner of the entire apparatus while extending the frame by applying their own weight to the anchoring foot.

Figure 6A:
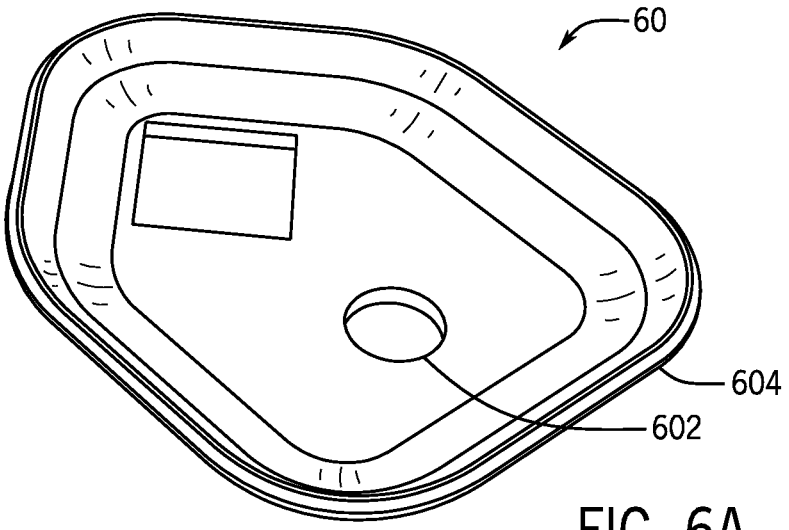
FIG. 6A illustrates a perspective view of an example sliding foot for supporting the example canopy shelter of FIG. 1.
Figure 6B:
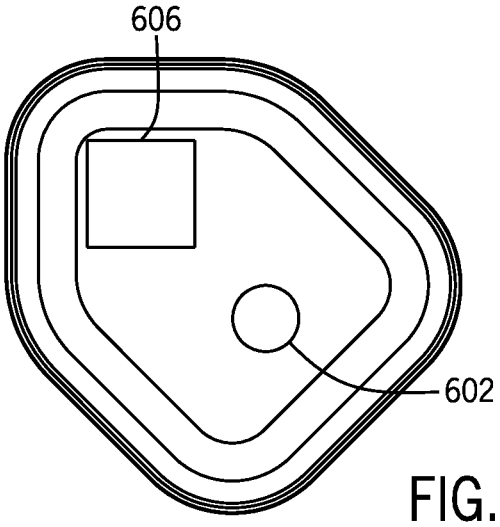
FIG. 6B is a top plan view of example sliding foot of FIG. 6A.
Figure 6C:
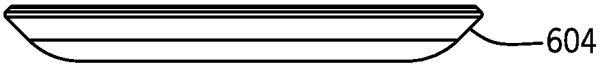
FIG. 6C is a side plan view of example sliding foot of FIG. 6A.
Figure 7C:
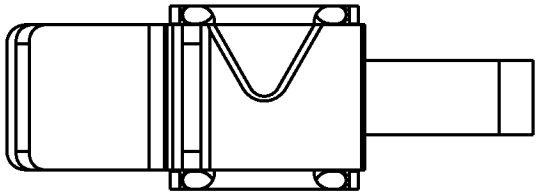
FIG. 7C is a first side plan view of example sliding bracket of FIG. 8A.
Figure 7D:
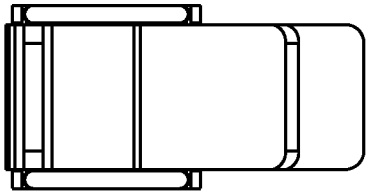
FIG. 7D is a second side plan view of example sliding bracket of FIG. 8A.
Figure 7A:
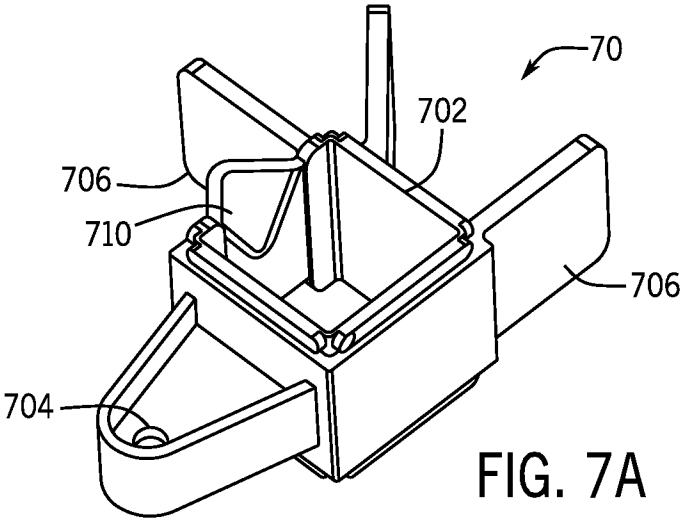
FIG. 7A illustrate various views of an example sliding bracket for coupling the canopy roof and leg supports to the example crank assembly.
Figure 7B:
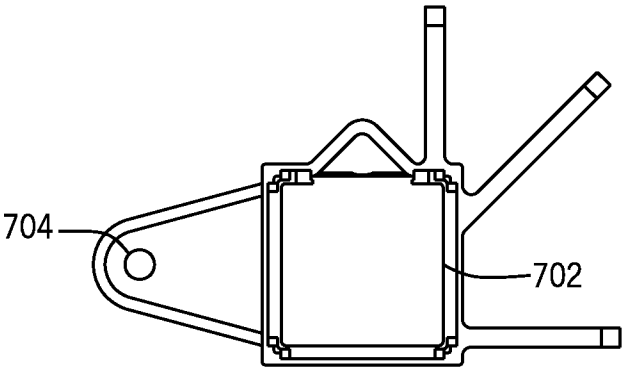
FIG. 7B is a top plan view of example sliding bracket of FIG. 8A.

Comparatively, the other feet are shown in FIGS. 6A-6C as an example sliding foot 60. Sliding foot 60 has a staking opening 602, curved portion 604, and leg mounting point 606. Curved portion 604 functions as a counterpoint to the anchoring foot 50. The curved portion 604 allows the other legs to slide away from the user as they operate the crank 20.

The various feet such as anchoring foot 50 and sliding foot 60 are made of a thermoplastic material in the example shown. Consideration is given by the manufacturer to material choice for these feet depending on the use case, for example, low surface energy materials may be desirable in an outdoor or arborial setting. Additional coverings, like a non-slip surface, may be added for a canopy intended for use on concrete or asphalt. In most use cases, stakes are used to fix the feet into the ground and prevent wind or other factors from moving the canopy.

Turning to FIGS. 7A-7D, an example sliding bracket 70 is shown. The sliding bracket 70 is used for coupling the extensible canopy frame to the example crank 20. The sliding bracket 70 includes an sliding aperture 702, a rope attaching point 704, and mounting elements 706, and groove 710. The sliding aperture 702 is sized and shaped to allow the bracket 70 to run over the leg 12. The rope attaching point allows the rope 234 (discussed above with respect to FIG. 3) to attach and apply tension and transmit this force to pull the entire extensible frame upright. The mounting elements 706 are used for attaching the extensible members 14 to each side of the sliding bracket. The bracket is locked in place by use of the groove 710 which interacts with a biased pin (not shown) to lock the leg into place.

Figure 8C:
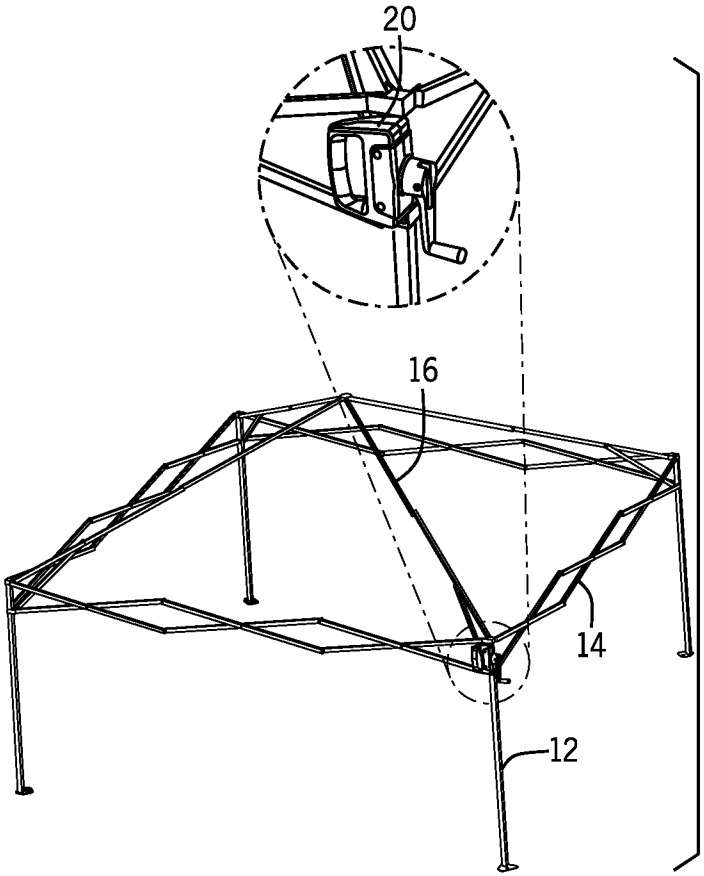
FIG. 8C is a pictorial illustration of a final step of one example method of deploying (erecting) the example canopy shelter of FIG. 1.
Figure 8B:
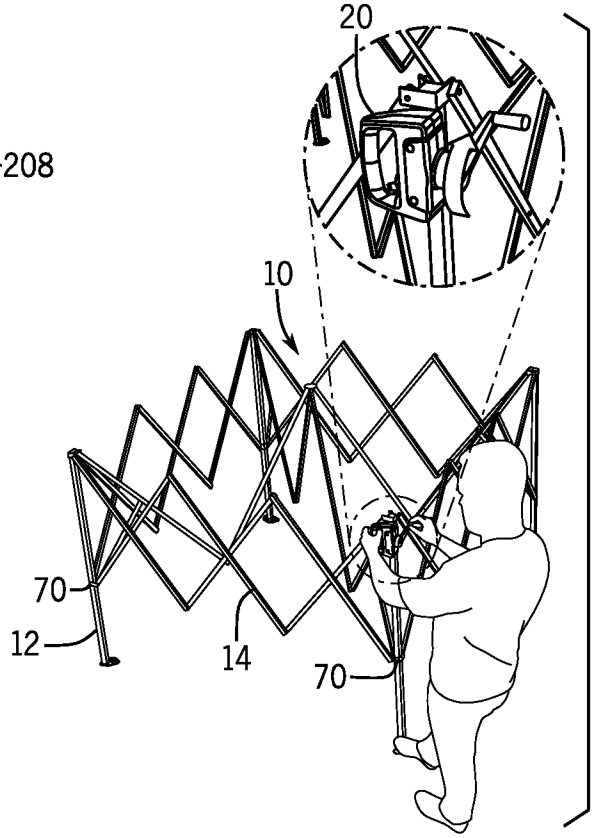
FIG. 8B is a pictorial illustration of a second step of one example method of deploying (erecting) the example canopy shelter of FIG. 1.
Figure 8A:
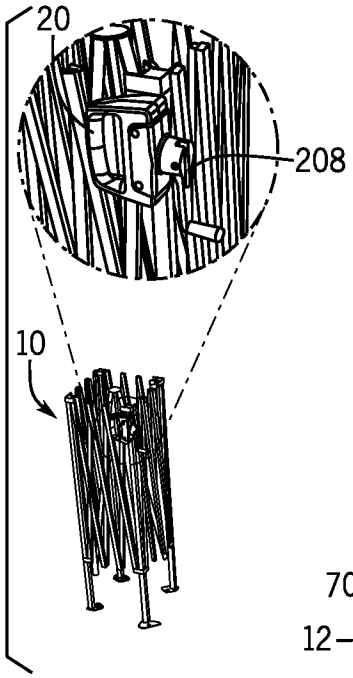
FIG. 8A is a pictorial illustration of a first step of one example method of deploying (erecting) the example canopy of FIG. 1.

FIGS. 8A-8C illustrate a pictorial illustration of one example method of deploying (erecting) the example canopy shelter. As stated above, the user begins erecting the canopy 10 by placing it in a upright position. The release lever 208 is engaged by closing it against the crank handle. The user can the lean the canopy system 10 slightly toward themselves and operate the crank 20. The crank 20 retrieves the rope affixed to the sliding bracket 70, thereby pulling it upward. As the bracket 70 moves upwards, the horizontal extensible members 14 stretch out, eventually, bringing the canopy 10 to its full size. The user walks around the canopy 10 and each leg 12 is locked manually. Stakes (not shown) can be used to secure the canopy 10 to the ground.

Figure 9C:
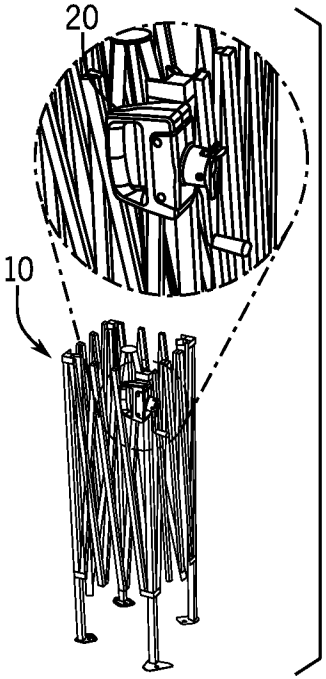
FIG. 9C is a pictorial illustration of a third step of one example method of collapsing the example canopy shelter of FIG. 1.
Figure 9B:
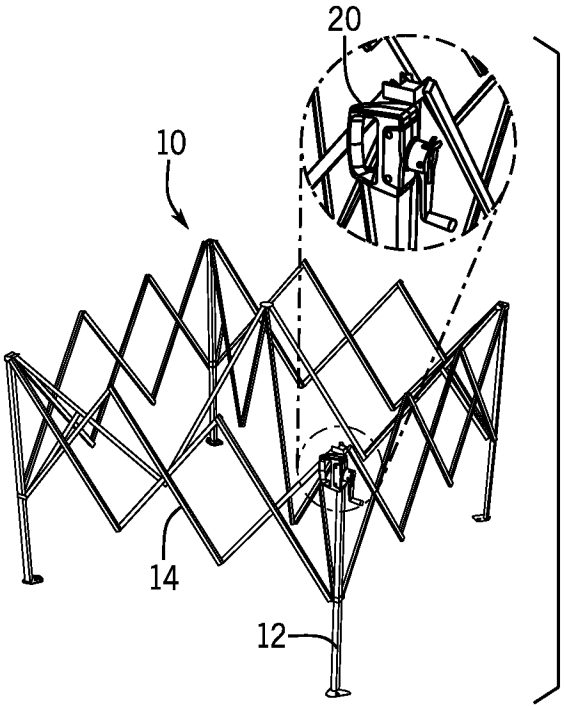
FIG. 9B is a pictorial illustration of a second step of one example method of collapsing the example canopy shelter of FIG. 1.
Figure 9A:
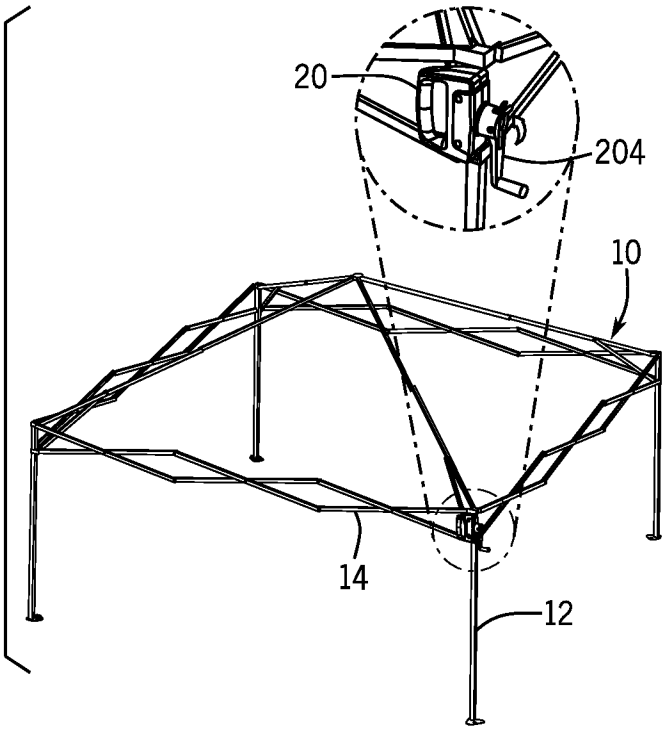
FIG. 9A is a pictorial illustration of a first step of one example method of collapsing the example canopy shelter of FIG. 1.

Conversely, FIGS. 9A-9C illustrate a pictorial illustration of one example method of collapsing the example canopy shelter. The user first disengages the release level 208 by lifting it upwards and unlocks each leg 12, removing any stakes from the ground. The user can then push the four legs 12 together to collapse the canopy 10.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A canopy comprising:

a plurality of legs;

a plurality of extensible members, each extensible member connected to one of the legs;

a lifting mechanism affixed to one of the legs;

a tether attached to the lifting mechanism; and a sliding bracket configured to be movably coupled to one or more of the legs, wherein the sliding bracket comprises:

a plurality of sides that define an aperture that extends from one end of the sliding bracket to an opposite end of the sliding bracket, wherein the aperture is configured to receive one of the legs, a plurality of mounting elements, each mounting element configured to attach to at least one of the extensible members, and a portion extending outwardly from one of the sides, wherein the portion comprises an attaching point at a distal end of the portion, wherein the attaching point is configured to connect to the tether.

2. The canopy of claim 1, wherein the lifting mechanism comprises a crank assembly.

3. The canopy of claim 2, wherein:

the crank assembly further comprises a crank handle; and rotation of the crank handle draws the tether toward the crank assembly lifting the sliding bracket and extending one or more of the extensible members.

4. The canopy of claim 1, wherein:

each leg comprises:

a foot on a distal end, a biased locking mechanism, and an extensible member bracket; and the sliding bracket further comprises a groove having an angled surface configured to move the biased locking mechanism inward when the sliding bracket passes over a portion of the leg having the biased locking mechanism from the foot toward the extensible member bracket.

5. The canopy of claim 4, wherein the foot of one leg has a stepping portion and the foot of one or more other legs has a sliding portion.

6. The canopy of claim 5, wherein the stepping portion is a flat top of the foot.

7. The canopy of claim 5, wherein the sliding portion is a curved surface on a bottom of the foot.

8. The canopy of claim 4, further comprising a plurality of stakes each configured to be received by an aperture in one or more of the feet.

9. The canopy of claim 4, wherein the plurality of legs comprises four legs.

10. The canopy of claim 1, wherein the plurality of extensible members comprises:

a plurality of vertical extensible members, each vertical extensible member connected to one leg and movably connected to each other vertical extensible member at a center point; and a plurality of horizontal extensible members, each horizontal extensible member connected between two different legs at a fixed point on each leg.

11. The canopy of claim 10, wherein the plurality of horizontal extensible members are arranged in a scissor pattern.

12. The canopy of claim 10, wherein the vertical extensible members further comprise at least one elbow joint.

13. The canopy of claim 10, wherein the lifting mechanism is configured to extend one or more of the vertical extensible members or one or more of the horizontal extensible members.

14. The canopy of claim 1, further comprising a covering.

15. The canopy of claim 14, wherein the covering is a waterproof rain fly.

* * * * *